United States Patent [19]

Tate et al.

[11] Patent Number: 4,793,912

[45] Date of Patent: Dec. 27, 1988

[54] PROCESS FOR PRODUCING A PITCH HAVING A LOW SOFTENING POINT

[75] Inventors: Kazuhito Tate; Hajime Yoshida; Teruhiko Sasaki, all of Kanagawa, Japan

[73] Assignee: Mitsubishi Oil Co., Ltd., Tokyo, Japan

[21] Appl. No.: 56,634

[22] Filed: Jun. 2, 1987

[30] Foreign Application Priority Data

Jun. 2, 1986 [JP] Japan ..... 61-125657

[51] Int. Cl.[4] ..... C10C 3/06; D01F 9/20

[52] U.S. Cl. ..... 208/44; 208/22; 208/39; 208/40; 208/23; 106/284; 106/273.1; 585/11; 528/247; 423/447.1; 423/447.4

[58] Field of Search ..... 208/22, 39, 40, 44, 208/23; 106/273 R, 284; 585/11; 528/247; 423/447.1, 447.4

[56] References Cited

U.S. PATENT DOCUMENTS

| | | | |
|---|---|---|---|
| 3,649,517 | 3/1972 | Kouach et al. | 208/22 |
| 3,723,609 | 3/1973 | Mansmann et al. | 423/447.1 |
| 3,784,679 | 1/1974 | Chiche | 423/447 |
| 3,927,186 | 12/1975 | Vinton et al. | 423/447.1 |
| 3,928,516 | 12/1975 | Sliva et al. | 423/447.1 |
| 4,146,576 | 3/1979 | Wyss | 423/447.4 |
| 4,457,828 | 7/1984 | Lewis | 423/447.4 |
| 4,670,129 | 6/1984 | Tate et al. | 423/447.4 |

FOREIGN PATENT DOCUMENTS

| | | | |
|---|---|---|---|
| 0027739 | 4/1981 | European Pat. Off. | 208/44 |
| 0072243 | 2/1983 | European Pat. Off. | |
| 0076427 | 4/1983 | European Pat. Off. | |
| 0090475 | 10/1983 | European Pat. Off. | 208/44 |
| 0120698 | 10/1984 | European Pat. Off. | |
| 0200965 | 12/1986 | European Pat. Off. | |
| 0219707 | 4/1987 | European Pat. Off. | |

*Primary Examiner*—H. M. S. Sneed
*Assistant Examiner*—Helane Myers
*Attorney, Agent, or Firm*—Sughrue, Mion, Zinn, Macpeak & Seas

[57] ABSTRACT

A process for producing an optically anisotropic pitch for use in the production of high performance carbon fibers, wherein a compound represented by the formula (1) as a raw starting material is mixed with one of heavy oils and subjected to thermal modification:

Formula (1)

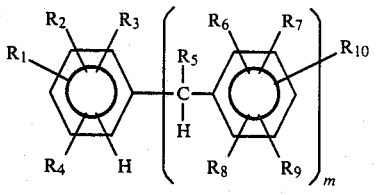

wherein m is an integer of 2 or more; $R_1$, $R_2$, $R_3$, $R_4$, $R_6$, $R_7$, $R_8$, $R_9$ and $R_{10}$ each represents a hydrogen atom, a methyl group or an ethyl group; and $R_5$ represents a hydrogen atom or a methyl group. The pitch has a softening point which can be set at discretion and excellent molecular orientation.

6 Claims, No Drawings

PROCESS FOR PRODUCING A PITCH HAVING A LOW SOFTENING POINT

FIELD OF THE INVENTION

The present invention relates to a process for producing a pitch which has excellent properties as a raw material for producing carbon fibers of a high strength and a high modulus of elasticity (high performance carbon fibers) and other carbon materials. More particularly, the invention is concerned with a process for producing an optically anisotropic pitch having a softening point which can be set at discretion and excellent molecular orientation in a state of developed optical anisotropy, wherein a compound comprising alkylbenzenes bonded together via methylene groups as a starting material is mixed with one of heavy oils and subjected to thermal modification.

BACKGROUND OF THE INVENTION

In general, carbon fibers are industrially produced by using rayon, PAN (polyacrylonitrile) or a pitch as a raw material. PAN is disadvantageous as it is expensive and the carbonization yield is low. In this respect, pitches are inexpensive and thus economically attractive. However, low cost carbon fibers produced from isotropic pitches are poor in orientation and, therefore, low in strength. These pitches cannot provide a high performance fiber. In contrast, carbon fibers produced from optically anisotropic pitches which are calles mesophase pitches have a highly orientated structure as well as excellent mechanical characteristics, i.e., high strength and a high modulus of elasticity. Thus, extensive studies have been made to produce mesophase pitches as raw materials for high performance carbon filbers from heavy oils such as petroleum catalytic cracking residual oil, naphtha tar pitch, or coal tar pitch. It has been confirmed by various experiments that when mesophase pitches are spun, molecules mainly composed of polycondensed aromatics are orientated in the direction of the fiber axis and thus high performance carbon fibers can be obtained. In order to produce high performance carbon fibers from pitches on an industrial scale, the pitches naturally should have a well-developed polycondensed aromatic structure wherein they are highly optically anisotropic. Additionally, from the industrial viewpoint of stable spinning for a long period of time, it is indispensable that pitches should have a sufficiently low spinning temperature in view of their decomposition temperature. In other words, the pitches should have a low softening point. Also, to improve the spinning properties, it is important that they should be homogeneous in quality and desirably in a 100% optically anisotropic phase. However, the mesophase pitch has disadvantages in that the viscosity is high and, therefore, the softening point is high because of the high interaction of polycondensed aromatics. For this reason, various studies have been conducted to improve the spinning properties of the mesophase pitch by lowering its softening point. When, however, a complicated mixture such as a petroleum pitch or a coal tar pitch was used singly as a starting material and subjected to a thermal modification for the purpose of developing a polycondensed aromatic structure, the resulting pitch did not have a significantly low softening point. In many cases, the mesophase pitch has been spun at temperatures as high as 340° C. to 380° C. At such high temperatures, however, the pitch is liable to undergo thermal decomposition and a thermal condensation reaction during the spinning process, thereby producing gas and high molecular weight substances. Thus, it has been difficult to carry out stable spinning of the mesophase pitch for long periods of time. In some instances, an attempt has been made to lower the softening point of the pitch at the sacrifice of its optical anisotropy.

SUMMARY OF THE INVENTION

The present invention provides a pitch completely different from the pitches described above. One object of the present invention is to provide a method for producing a pitch having a well-developed optically anisotropic structure and a discretionary softening point, wherein a chemically synthesized compound having a specified chemical structure mixed with one of heavy oils is used as a starting material. In other words, an object of the present invention is to provide an optically anisotropic pitch which has an excellent molecular orientation and can be spun easily and stably at a much lower temperature for long periods of time than in the case of the conventional mesophase pitch.

This and other objects have been attained by providing a process for producing an optically anisotropic pitch, comprising mixing a compound represented by the formula (1) and one of heavy oils which give an optical anisotropy when heated and subjecting the mixture as a raw material to thermal modification:

Formula (1)

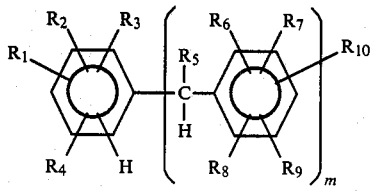

wherein m is an integer of 2 or more; $R_1$, $R_2$, $R_3$, $R_4$, $R_6$, $R_7$, $R_8$, $R_9$ and $R_{10}$ each represents a hydrogen atom, a methyl group or an ethyl group; and $R_5$ represents a hydrogen atom or a methyl group.

DETAILED DESCRIPTION OF THE INVENTION

The term "optical anisotropy" of a pitch in the present specification refers to an area where a light brightness is observed when a cross section of a pitch clump solidified at around room temperature is polished and examined under a crossed Nicol of a reflection type polarization microscope. The proportion of an optically anisotropic phase is determined based on such an area and is indicated in percentage (%). "Toluene-insoluble content" and "quinoline-insoluble content" are determined by the methods specified in JIS K2425. Also, "softening point" refers to the temperature at which, under observation via a hot stage type microscope, pitch powder begins to deform when raised in temperature at a rate of 10° C./min in a nitrogen atmosphere.

The present invention can be applied to any of the conventional starting materials such as residual oil from fluid catalytic cracking, naphtha tar pitch or coal tar pitch. In this invention, these heavy oils are mixed with a suitable amount of a compound having a specified chemical structure and the mixture is subjected to thermal modification, whereby a pitch having a well-developed optically anisotropic structure and a softening point which can be set at discretion is produced. The pitch obtained has a low softening point in spite of its larger proportion of optical anisotropy compared with that of the pitch produced from one of the above heavy oils alone. The invention provides a process for producing a completely new type of optically anisotropic pitch which can be stably spun at a much lower temperature than that of the conventional mesophase pitch.

In order to prepare such a pitch, it is necessary to carry out the preparation using as one of the raw materials a compound having a specified chemical structure under sufficiently controlled conditions. The compound used as such a raw material is represented by the formula (1) comprising alkylbenzenes bonded to each other via a methylene group:

Formula (1)

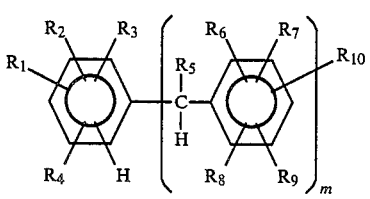

wherein m is an integer of 2 or more; $R_1$, $R_2$, $R_3$, $R_4$, $R_6$, $R_7$, $R_8$, $R_9$ and $R_{10}$ each represents a hydrogen atom, a methyl group or an ethyl group; and $R_5$ represents a hydrogen atom or a methyl group.

The substituent for an alkylbenzene is preferably a methyl or an ethyl group, and alkyl substituents having longer chains than an ethyl group are not suitable for the purpose of this invention.

The compound of the present invention can be, for example, produced from a polymer obtained by reacting an alkylbenzene with formaldehyde or acetaldehyde in the presence of protonic acid as a catalyst. The alkylbenzenes used can be the same or a mixture of different ones. The formaldehyde or acetaldehyde can be used in any desired form so far as the aldehyde is released in the reaction system, e.g., formaldehyde, paraformaldehyde, trioxane or paraldehyde.

In addition, the compound of the present invention can be obtained as a fraction containing alkylbenzene trimers or higher oligomers by dehydrating polymerization of a xylene-formaldehyde resin or a mesithylene-formaldehyde resin with an alkylbenzene in the presence of protonic acid as a catalyst. The alkylbenzenes used can be the same or a mixture of different ones.

An important requirement in this process is that the oxygen content of said fraction prepared by polycondensation should be not more than 5 wt%, preferably not more than 1 wt%. A fraction with a higher oxygen content than this contains less of the present invention's compound of formula (1), so that the fraction is readily decomposed by thermal modification, thereby not only lowering the yield but also raising the softening point of the pitch to be obtained. Thus, a polymer having a high oxygen content cannot be used in the present invention.

Further, compounds prepared according to any other methods are usable so far as they are represented by the formula (1).

The present invention provides a pitch by mixing the above-mentioned compound with one of the heavy oils which are raw materials for producing an optically anistropic pitch. The heavy oils used in the present invention can be any of those which give an optically anisotropic pitch when heated, e.g., residual oil from fluid catalytic cracking, naphtha tar pitch or coal tar pitch. As a matter of course, one of the heavy oils which is conducted a solvent extraction or a hydrogenation is also used. Since a mesophase pitch has the structure of polycondensed aromatic molecules in layers, if pitches are prepared from one of the heavy oils and the compound and then mixed, the simple mixing of the pitches cannot thoroughly homogenize their molecules. A mesophase pitch of which molecules are homogeneously mixed can only be obtained by sufficiently mixing the raw materials and then subjecting the resulting mixture to thermal modification. Also, as a matter of course, the compound to be used should be one having polycondensed aromatics which will easily form in layers, i.e., one which will be easily modified into a mesophase pitch. The compound of the present invention is found to be suitable for this reason.

Although conditions of the thermal modification for preparing an optically anisotropic pitch from the heavy oils and the compound depend on the kind of compound and heavy oil as well as their properties, there are the following two main methods for the treatment: In the first method, the compound and one of the heavy oils are mixed beforehand and the mixture is reacted either in a state of reflux under atmospheric pressure normally at 380° C. to 440° C. for 0.5 to 20 hours, or at 400° C. to 470° C. under pressure at 3 to 30 kg/cm$^2$ for 0.5 to 10 hours to produce a thermally reformed mixture. Then, the resulting mixture is subjected to thermal modification either at 380° C. to 450° C. for 0.2 to 10 hours under reduced pressure of not more than 30 mmHg, preferably not more than 10 mmHg, or at 380° C. to 450° C. for 0.2 to 10 hours under atmospheric pressure while blowing an inert gas into the mixture, whereby a polycondensed aromatic structure is developed to produce an optically anisotropic pitch.

Another method is to carry out the reaction by two steps. The compound and one of the heavy oils are heated separately to let them undergo reforming reactions. As a second step, the obtained reformed products are mixed and subjected to thermal modification to produce the pitch. In more detail, in the first step it is desirable to carry out the reforming reactions by heating the compound and one of the heavy oils separately under optimum conditions. For example, the compound is generally reacted either at 380° to 440° C. under atmospheric pressure in a state of reflux for 0.2 to 20 hours or at 400° C. to 470° C. under pressure at 3 to 30 kg/cm$^2$ for 0.5 to 10 hours. Each of the heavy oils can also be reacted under its optimum conditions as usually applied and there are no particular restrictions on the conditions. Fluid catalytic cracking residual oil, for example, is reacted generally at 380° C. to 440° C. under atmospheric pressure in a state of reflux for 0.5 to 20 hours or at 400° C. to 470° C. under pressure at 3 to 30 kg/cm$^2$ for 0.5 to 10 hours. Then, in the second step, these thermally reformed substances are mixed in such a ratio as will give a pitch having the desired properties. The mixture is subjected to thermal modification either at 380° C. to 450° C. under reduced pressure of 30 mmHg or lower, preferably 10 mmHg or lower, for 0.2 to 10 hours, or at 380° C. to 450° C. under atmospheric pressure for 0.2 to 10 hours while blowing an inert gas into the mixture, whereby a polycondensed aromatic structure is developed to produce an optically anisotropic pitch.

The mixing ratio of the heavy oils and the compound is chosen depending on the desired softening point of the pitch from the range of the ratio of the compound/-the oil=5/95 to 95/5 (ratio by weight). The larger the ratio of the compound to the oil is, the lower the softening point of the obtained pitch is and the better the spinning property of the pitch is.

In order to obtain high performance carbon fibers, it is important for a pitch to have its molecules orientated along the direction of the fiber axis in the state of spinning, and it is desirable that the pitch is highly optically anisotropic. Additionally, it is easily conjectured that in order to improve the strength of the fibers, the orientated molecular structure should be long in the direction of the fiber axis.

When the present invention's compound which comprises alkylbenzenes bonded together via a methylene group is subjected to thermal modification, a polycondensed aromatic structure is easily formed wherein adjacent benzene rings cyclize via alkyl side chains. Further, as alkyl substituents of such compounds are maintained to some extent during the thermal modification, interactions between the molecules become slow although condensed ring structures are easily formed. Therefore, when a compound having such a specified molecular structure is mixed with one of heavy oils to prepare a pitch, it means that the molecules constituting said polycondensed aromatic structure are mixed. Thus, the pitch of the present invention having a high optical anisotropy and a low softening point can be obtained, and carbon fibers produced from this pitch have high strength and a high modulus of elasticity.

In further detail, it is indispensable to produce high performance fibers that the molecules of a pitch should be orientated along the direction of the fiber axis at the stage of spinning, and it is desirable that the pitch is highly optically anisotropic. To accomplish these factors, the pitch to be used as a raw material should have an optical anisotropy of higher than 85%, preferably of higher than 95%. Generally, however, the higher the optical anisotropy, the higher the softening point, and thermal decomposition and thermal condensation of the pitch tend to occur during the spinning. Therefore, the lower softening point makes spinning easy and stable for a prolonged period of time. The characteristics of the present invention's pitch are that even the pitch having an optical anisotropy of higher than 95% has a softening point of 220° C. to 270° C. Moreover, the softening point can be chosen at discretion by changing the mixing ratio of the two materials, that is, the lower the softening point is, the more the compound is.

The content of an optically anisotropic phase and the quinoline insolubles and a softening point of the pitch correlate to each other. Consequently, it is difficult to lower the content of the quinoline insolubles and set a softening point at discretion in highly optically anisotropic pitch. The quinoline insoluble does not melt by itself and is dissolved in the other fraction of the pitch. And it gives bad effect on the spinning property of the pitch if the quinoline insoluble content of the pitch becomes larger. On the viewpoint, the quinoline insoluble content is preferable to be not more than 15 wt%. The quinoline insoluble content of the present invention's pitch can be made lower than that of a pitch prepared from the oil itself. The low quinoline insoluble content and low softening point result in the good spinning property of the pitch and then the strength and the modulus of elasticity of the carbon fibers to be obtained are improved.

The present invention is further explained in detail according to Examples below, which are not intended to be limiting.

Unless otherwise specified, all ratios, percents, etc., are by weight.

EXAMPLE 1

550 g of xylene, 100 g of paraformaldehyde, 200 g of 83% sulfuric acid were placed in a flask equipped with stirring blades and a reflux condenser and reacted at 110° C. for 5 hours. After the reaction, the solution was diluted with 500 g of toluene, and the mixture of toluene and the reaction solution was washed with purified water until the aqueous phase became neutral. Then, unreacted materials are removed by vacuum distillation (120° C./10 mmHg) to obtain 300 g of a polymer.

The polymer was further subjected to distillation under reduced pressure (200° C./1 mmHg) to obtain 120 g of distilled oil and 180 g of a compound as a still residue. It was confirmed by an elemental analysis, GPC and a mass analysis that the principal component of this compound was a fraction wherein 3 or more of xylenes are bonded together through methylene groups. The oxygen content of this fraction was 0.1 wt%.

10 g of the compound obtained by the above method were added to 90 g of a heavy fraction having a boiling point of 400° C. or higher from fluid catalytic cracking oil and reacted under reflux at 420° C. in an inert gas atmosphere for 8 hours. The resulting reaction solution was converted to a mesophase pitch under reduced pressure (10 mmHg) at 400° C. while removing light fractions. 23.8 g of a pitch was obtained. This pitch had an optical anisotropy of 95%, a softening point of 265° C., a toluene-insoluble content of 76.6 wt% and a quinoline-insoluble content of 12.0 wt%.

EXAMPLES 2, 3 AND 4

Pitches were prepared by changing the mixing ratios of the compound and the heavy fraction having a boiling point of 400° C. or higher from fluid catalytic cracking oil in Example 1. The mixing ratios of starting materials, reaction conditions and properties of pitches are shown in Table 1.

COMPARATIVE EXAMPLE 1

A pitch was prepared according to the same method as in Example 1 except using only the heavy fraction having a boiling point of 400° C. or higher from fluid catalytic cracking oil. The yield of the pitch was 30.0% and it had an optical anisotropy of 85%, a softening point of 280° C., a toluene-insoluble content of 80.9 wt% and a quinoline-insoluble content of 13.9 wt%. The production conditions and properties of the pitch are shown in Tables 1 and 2.

COMPARATIVE EXAMPLE 2

A pitch having an optical anisotropy of 95% was prepared in the same manner as in Example 1 except using only the heavy fraction having a boiling point of 400° C. or higher from fluid catalytic cracking oil. The pitch had a softening point of 300° C., a toluene-insoluble content of 87.2 wt% and a quinoline-insoluble content of 23.1 wt%. The production conditions and properties of the pitch are shown in Tables 1 and 2.

EXAMPLE 5

1,080 g of $C_9$ aromatic fraction (a fraction having a boiling point of 160° C. to 180° C. of heavy reformate), 900 g of paraformaldehyde, 3,320 g of 78% sulfuric acid were placed in a flask equipped with stirring blades and a reflux condenser and reacted at 100° C. for 4 hours. After the reaction, the solution was diluted with 2,000 g of toluene, and the mixture of toluene and the reaction solution was washed with purified water until the aqueous phase became neutral. Unreacted materials were removed by vacuum distillation (120° C./10 mmHg) to obtain 530 g of a polymer.

Then, the polymer was further subjected to distillation under reduced pressure (200° C./1 mmHg) to obtain 190 g of distilled oil and 340 g of a compound as a still residue. It was confirmed by an elemental analysis, GPC and a mass analysis that the principal component of this compound was a fraction wherein trimethylbenzenes are bonded together through methylene groups. The oxygen content of the fraction was 0.1 wt%.

100 g of the compound obtained by the above method was reacted in an inert gas atmosphere of nitrogen under reflux at 410° C. for 5 hours to obtain 60 g of a thermally reformed substance (a). On the other hand, 100 g of a heavy fraction having a boiling point of 400° C. or higher from fluid catalytic cracking oil were also reacted in an inert gas atmosphere of nitrogen under reflux at 420° C. for 8 hours. 78 g of a thermally reformed substance (b) were obtained.

10 g of the thermally reformed substance (a) and 90 g of the thermally reformed substance (b) prepared in the above method were mixed and converted to a mesophase pitch under reduced pressure (10 mmHg) at 400° C. while removing light fractions to obtain 37.8 g of a pitch. This pitch had an optical anisotropy of 95%, a softening point of 265° C., a toluene-insoluble content of 73.0 wt% and a quinoline-insoluble content of 6.5 wt%.

EXAMPLES 6, 7 AND 8

The thermally reformed substance (a) of the compound and the thermally reformed substance (b) of fluid catalytic cracking oil prepared in Example 5 were mixed by changing the mixing ratios and converted to mesophase pitches under reduced pressure (10 mmHg) at 400° C. while removing light fractions. The thermal reforming reaction conditions, mixing ratio of the thermally reformed substances and properties of the pitches are shown in Table 2.

TABLE 1

Conditions for Producing Pitches and Their Properties

| Example No. | Mixing Ratio (Compound/ Heavy Oil) (wt/wt) | Heating Treatment Conditions (°C. × h) | Anisotropy (%) | Softening Point (°C.) | Quinoline-Insoluble Content (wt %) | Toluene-Insoluble Content (wt %) | H/C |
|---|---|---|---|---|---|---|---|
| Example 1 | 10/90 | 420 × 8 | 95 | 265 | 12.0 | 76.6 | 0.600 |
| Example 2 | 20/80 | 420 × 8 | 100 | 270 | 10.5 | 72.3 | 0.608 |
| Example 3 | 50/50 | 420 × 8 | 100 | 255 | 7.7 | 59.4 | 0.635 |
| Example 4 | 80/20 | 420 × 8 | 100 | 240 | 3.9 | 46.6 | 0.662 |
| Comparative Example 1 | 0/100 | 420 × 8 | 85 | 280 | 13.9 | 80.9 | 0.590 |
| Comparative Example 2 | 0/100 | 420 × 10 | 95 | 300 | 23.1 | 87.2 | 0.570 |

TABLE 2

Conditions for Producing Pitches and Their Properties

| Example No. | Mixing Ratio of Thermally Modified Substances (Compound/ Heavy Oil) (wt/wt) | Conditions for Thermal Modification: Compound (°C. × h) | Conditions for Thermal Modification: Heavy Oil (°C. × h) | Conditions for Formation of Pitch (°C. × mmHg) | Anisotropy (%) | Softening Point (°C.) | Quinoline-Insoluble Content (wt %) | Toluene-Insoluble Content (wt %) | H/C |
|---|---|---|---|---|---|---|---|---|---|
| Example 5 | 10/90 | 410 × 5 | 420 × 8 | 400 × 10 | 95 | 265 | 6.5 | 73.0 | 0.595 |
| Example 6 | 20/80 | 410 × 5 | 420 × 8 | 400 × 10 | 95 | 260 | 5.0 | 66.6 | 0.600 |
| Example 7 | 50/50 | 410 × 5 | 420 × 8 | 400 × 10 | 100 | 245 | 8.6 | 56.0 | 0.660 |
| Example 8 | 80/20 | 410 × 5 | 420 × 8 | 400 × 10 | 100 | 225 | 6.5 | 44.0 | 0.730 |
| Comparative Example 1 | 0/100 | — | 420 × 8 | 400 × 3 | 85 | 280 | 13.9 | 80.9 | 0.590 |
| Comparative Example 2 | 0/100 | — | 420 × 10 | 400 × 3 | 95 | 300 | 23.1 | 87.2 | 0.570 |

As described above, the pitch of the present invention can easily set its softening point to lower temperature than that of the conventional coal or petroleum-based pitch at discretion in the state of high optical anisotropy. Thus, the pitch of the present invention processes excellent properties as a pitch for production of carbon fibers.

While the invention has been described in detail and with reference to specific embodiments thereof, it will be apparent to one skilled in the art that various changes and modifications can be made therein without departing from the spirit and scope thereof.

What is claimed is

1. A process for producing an optically anisotropic pitch, wherein said pitch is produced from a compound represented by formula (1) and one of heavy oils selected from the group consisting of a residual oil from fluid catalytic cracking, a naphtha, tar pitch or a coal tar pitch:

Formula (1)

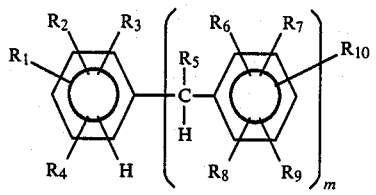

wherein m is an integer of 2 or more; $R_1$, $R_2$, $R_3$, $R_4$, $R_6$, $R_7$, $R_8$, $R_9$ and $R_{10}$ each represents a hydrogen atom, a methyl group or an ethyl group; and $R_5$ represents a hydrogen atom or a methyl group; and said process is carried out by: (1) subjecting said compound alone to a thermal reforming reaction at 380°–440° C. for 0.2 to 20 hours under atmospheric pressure, or at 400°–470° C. for 0.5 to 10 hours under pressure, and separately subjecting one of said heavy oils alone to a thermal reforming reaction at 380°–440° C. for 0.5 to 20 hours under atmospheric pressure, or at 400°–470° C. for 0.5 to 10 hours under pressure in a first step, and (2) mixing the obtained thermally reformed compound and one of said heavy oils in a range of 5:95 to 95:5 by weight, and subjecting the mixture to thermal modification in order to produce a pitch having an optical anisotropy of 95% or more, a softening point of 220°–270° C., and a quinoline-insoluble content of not more than 15 wt% in a second step.

2. A process for producing an optically anisotropic pitch in claim 1, wherein said compound is a polymer comprising three or more alkylbenzenes bound together through methylene groups, which is prepared by polymerizing (a) alkylbenzenes substituted by 1 to 4 methyl groups or ethyl groups, said alkylbenzenes being the same or different, and (b) formaldehyde or acetaldehyde, in the presence of protonic acid as a catalyst.

3. A process for producing an optically anisotropic pitch as in claim 1, wherein said compound is a polymer comprising three or more alkylbenzenes bound together through methylene groups, which is prepared by condensating (a) alkylbenzenes substituted by 1 to 4 methyl groups or ethyl groups, said alkylbenzenes being the same or different, and (b) a xylene-formaldehyde resin or a mesithylene-formaldehyde resin in the presence of protonic acid as a catalyst.

4. A process for producing an optically anisotropic pitch, wherein said pitch is produced from a compound represented by formula (1) and one of heavy oils selected from the group consisting of a residual oil from fluid catalytic cracking, a naphtha tar pitch or a coal tar pitch:

Formula (1)

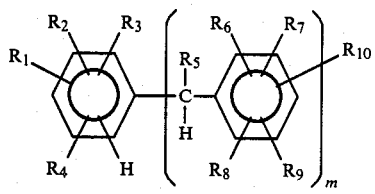

wherein m is an integer of 2 or more; $R_1$, $R_2$, $R_3$, $R_4$, $R_6$, $R_7$, $R_8$, $R_9$ and $R_{10}$ each represents a hydrogen atom, a methyl group or an ethyl group; and $R_5$ represents a hydrogen atom or a methyl group; and said process is carried out by (1) mixing said compound and one of said heavy oils in a range of 5:95 to 95:5 by weight, (2) thermally reforming said mixture at 380°–440° C. for 0.5 to 20 hours under atmospheric pressure or at 400°–470° C. for 0.5 to 10 hours under pressure, and (3) subjecting the said thermally reformed mixture to thermal modification in order to produce a pitch having an optical anisotropy of 95% or more, a softening point of 220°–270° C., and a quinoline-insoluble content of not more than 15 wt%.

5. A process for producing an optically anisotropic pitch as in claim 4, wherein said compound is a polymer comprising three or more alkylbenzenes bound together through methylene groups, which is prepared by polymerizing (a) alkylbenzenes substituted by 1 to 4 methyl groups or ethyl groups, said alkylbenzenes being the same or different and (b) formaldehyde or acetaldehyde, in the presence of protonic acid as a catalyst.

6. A process for producing an optically anisotropic pitch as in claim 4, wherein said compound is a polymer comprising three or more alkylbenzenes bound together through methylene groups, which is prepared by condensating (a) alkylbenzenes substituted by 1 to 4 methyl groups or ethyl groups, said alkylbenzenes being the same or different, and (b) a xylene-formaldehyde resin or mesithylene-formaldehyde resin in the presence of protonic acid as a catalyst.

* * * * *